US010775130B1

(12) United States Patent
Cass

(10) Patent No.: US 10,775,130 B1
(45) Date of Patent: Sep. 15, 2020

(54) HOLSTER FOR ASSAULT RIFLE

(71) Applicant: Joseph Cass, King George, VA (US)

(72) Inventor: Joseph Cass, King George, VA (US)

( * ) Notice: Subject to any disclaimer, the term of this patent is extended or adjusted under 35 U.S.C. 154(b) by 0 days.

(21) Appl. No.: 16/501,212

(22) Filed: Mar. 8, 2019

(51) Int. Cl.
*F41C 33/00* (2006.01)

(52) U.S. Cl.
CPC ..... *F41C 33/007* (2013.01)

(58) Field of Classification Search
CPC .... F41C 33/007; F41C 33/001; F41C 33/002; F41C 33/006; F41C 33/008
See application file for complete search history.

(56) References Cited

U.S. PATENT DOCUMENTS 2,919,058 A * 12/1959 Thompson ..... B60R 7/14 224/546
3,348,746 A * 10/1967 Stumpf ..... A41D 13/0012 2/94
3,556,363 A * 1/1971 Whittaker ..... B60R 7/14 224/546
8,438,811 B1 * 5/2013 Woodard ..... B60R 7/14 52/506.05
2013/0146628 A1 * 6/2013 Gump ..... F41C 33/007 224/257
2013/0276343 A1 * 10/2013 Peters ..... F41C 33/006 42/90
2014/0151413 A1 * 6/2014 Ponder ..... F41C 33/007 224/149
2014/0190054 A1 * 7/2014 Ascano ..... F41C 33/007 42/71.01
2015/0233669 A1 * 8/2015 Ponder ..... F41C 33/001 224/271
2015/0377585 A1 * 12/2015 Fowler ..... F41C 33/0236 224/271

* cited by examiner

*Primary Examiner* — Corey N Skurdal
(74) *Attorney, Agent, or Firm* — Thomas J. Wallen, P.E. Attorney at Law, L.L.C.

(57) ABSTRACT

A holster is disclosed specially adapted for an assault weapon, the assault weapon having a pistol grip and a magwell. The holster comprises two separate brackets, an upper bracket and a lower bracket, where both the upper and lower holster brackets are adapted to be supported by a tactical vest with MOLLE webbing. The upper holster bracket has two terminal ends including two wings on the two terminal ends formed in a partial retrograde fashion to fold away from and oppose each other. The two wings can be manually spread apart in order to accept and surround the pistol grip of an assault weapon. The upper holster bracket is formed to surround the pistol grip of the assault weapon, and wherein the two wings rebound to their initial shape after providing a secure interference fit with the pistol grip of the assault weapon. A lower holster bracket in an approximate "U" shape is adapted to engage and support the magwell of an assault weapon and attaches to lower MOLLE webbing of the tactical vest.

20 Claims, 7 Drawing Sheets

HOLSTER FOR ASSAULT RIFLE

FIELD OF THE INVENTION

The present invention is directed to a holster adapted to safely hold an assault type weapon upon the forward torso of a user. The holster securely affixes the weapon to the body of the user in a position where it can be accessed rapidly while at the same time being immobilized. The holster affords the user the ability to store the weapon in a position where it is rapidly deployable while maintaining both hands free.

BACKGROUND OF THE INVENTION

Assault rifles are commonly carried by both law enforcement in the performance of their civilian duty and by the military in armed combat situations. Because of the length and size of assault type weapons, as exemplified by the Colt M-16 or M-16 clones, the weapons require the dedication of at least one-hand at all times to maintain control of the weapon. This encumbers a soldier or law enforcement officer by restricting their movements to one hand in emergency situations. Frequently two hands are required under emergency or combat scenarios, which cannot be accomplished when one hand is dedicated to maintaining control of the assault weapon. There exists a need for a holster to securely and safely hold the assault weapon on the person of the soldier or law enforcement officer, while enabling rapid deployment of the weapon.

SUMMARY OF THE INVENTION

The instant invention provides a two-piece attachment comprising an upper bracket and a lower bracket for attachment to conventional tactical vests of the type worn by military personnel or law enforcement officers. The upper bracket of the holster readily slides over one of the belts that are commonly provided with tactical vests. These belts are referred to as MOLLE webbing or MOLLE strapping and are universally one-inch in width. Although the standard MOLLE webbing width is one-inch it is expressly understood that the invention is adaptable to webbing of any material or width. This upper bracket of the holster is specifically adapted to removably attach to the pistol grip of an assault weapon. The lower bracket of the holster slides over another, preferably lower MOLLE webbing of the tactical vest and removably attaches to the lower front and side faces of assault weapon's magwell. Both the upper bracket and the lower bracket can be oriented at various positions on the MOLLE webbing to accommodate the user's personal preference and comfort. When secured to the user's body in this way the assault weapon is securely affixed to the user's body and crosses his torso with the muzzle pointing downward in a safe fashion. When the weapon is being retrieved from the holster, the pistol grip is close to the normal operating position assumed when the weapon is being fired. The user is able to quickly remove the weapon from the holster and be in a ready to fire position nearly simultaneously.

Because the weapon is securely attached to the holster, the law enforcement officer or soldier has two hands free, providing a substantial tactical advantage to the user. The holster can be used when the user is in a seated, or standing position. In use it has been found that the assault weapon remains secure even when the user encounters an accidental or deliberate fall, rolls, or drops to a safe position whenever necessary depending on conditions.

DETAILED DESCRIPTION OF PREFERRED EMBODIMENTS

According to the instant invention a holster is disclosed that is specially adapted to securely affix an assault weapon to the front torso of a user. The holster is designed to attach to a conventional tactical vest with belts, normally MOLLE webbing or MOLLE strapping. In this specification, the term "MOLLE" refers to well known in the art webbing/strapping systems and stands for Modular Lightweight Load-Carrying Systems and the strapping/webbing system stands for "PALS" (Pouch Attachment Ladder System) and the term "magwell" stands for magazine well.

The holster comprises two pieces, an upper holster bracket and a lower holster bracket. The upper holster bracket is attached to MOLLE webbing on the tactical vest and is specifically shaped to snap over the pistol grip of an assault weapon, such as a Colt M-16 or an M-16 clone. Although Colt M-16 type weapons are describe herein, it is expressly understood that the invention is not limited to any particular weapon. The lower holster bracket also attaches to MOLLE webbing located on a conventional tactical vest, preferably a lower MOLLE webbing of the vest. The lower holster bracket snaps over the magwell of the assault weapon.

Figure 1:
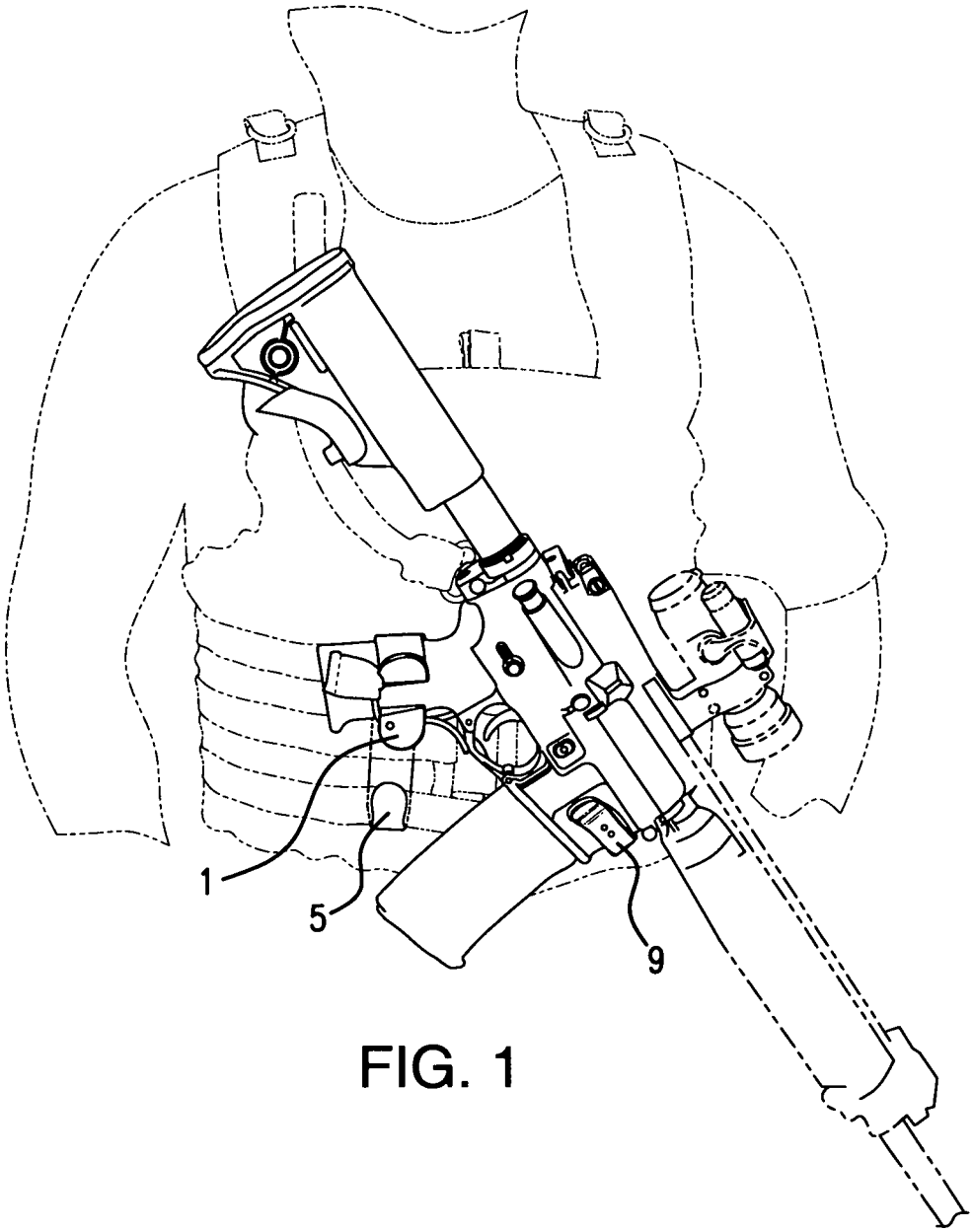
FIG. 1 shows the holster according to the invention, attached to a tactical vest worn by an armed user, with an assault rifle secured to the tactical vest.

FIG. 1 shows the combination of a tactical vest with the upper and lower holster brackets attached to the vest. FIG. 1 additionally shows an assault weapon holstered by the holster of the invention and being worn by a user in a combat ready position. Upper holster bracket (1) secures the pistol grip of the assault weapon and lower holster bracket (9) secures the magwell of the assault weapon. As can readily be seen, the muzzle safely points downward towards the ground.

Figure 2:
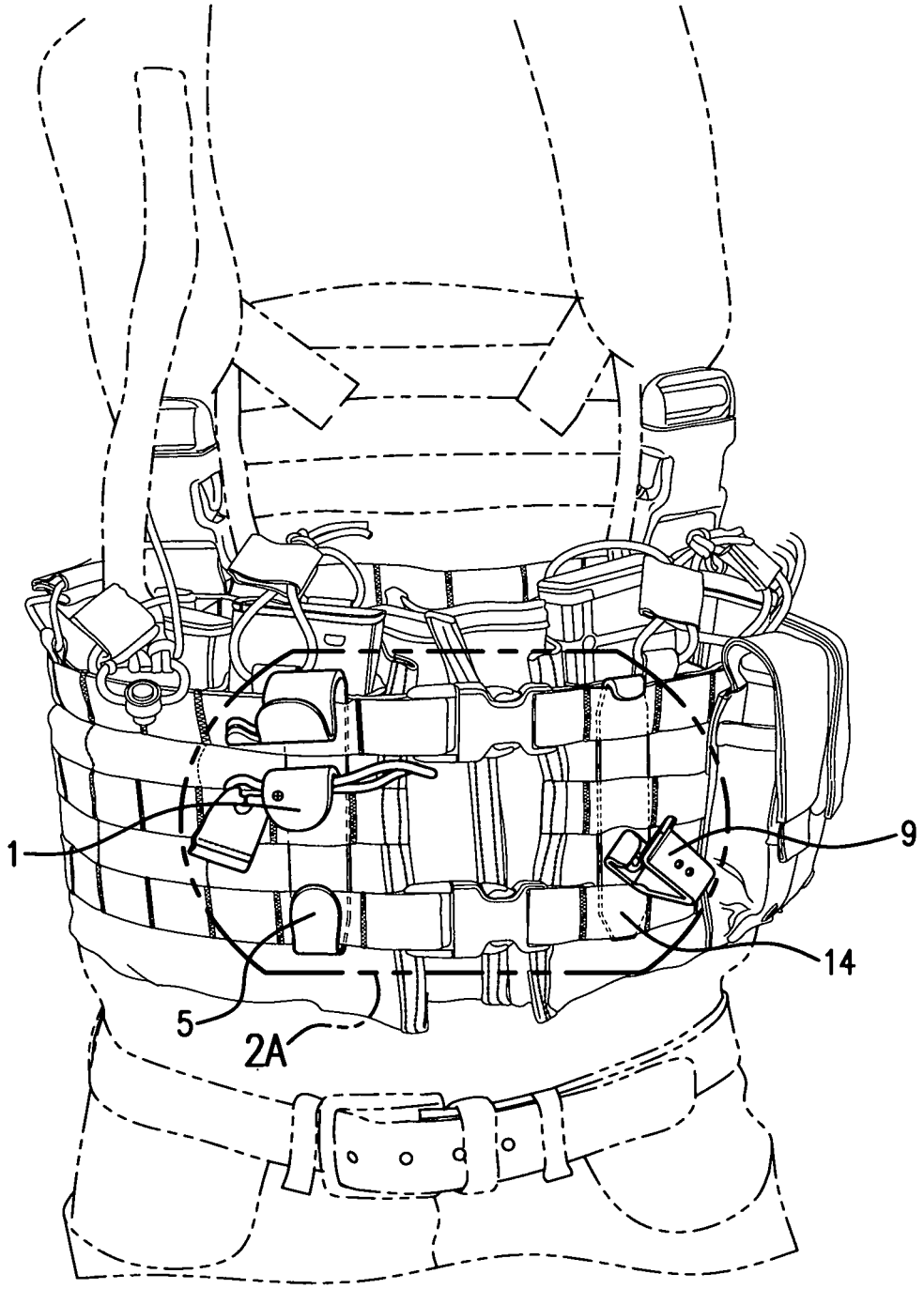
FIG. 2 shows the holster according to the invention attached to a tactical vest with no assault rifle holstered to the tactical vest.
Figure 2A:
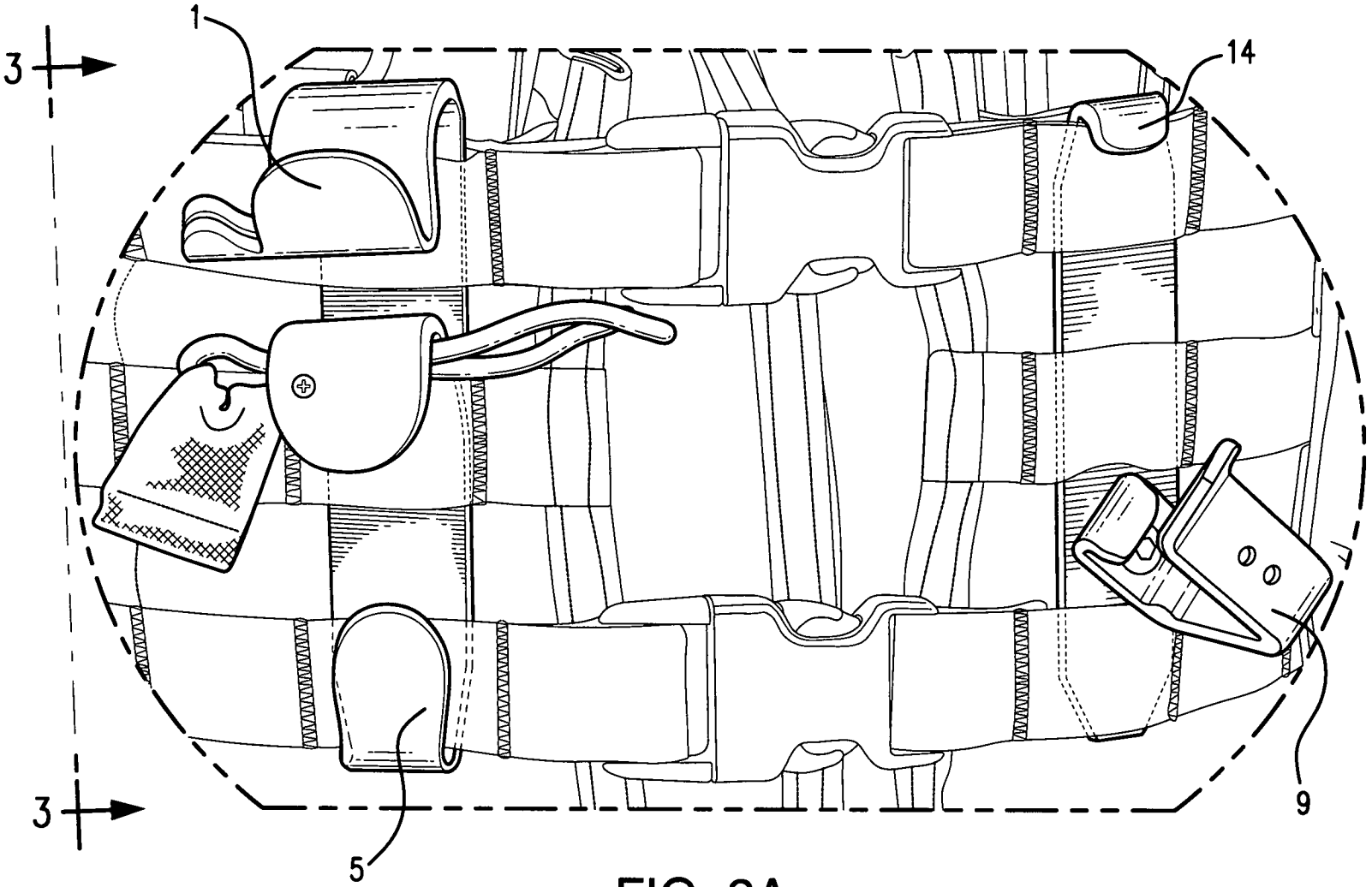
FIG. 2A is an enlargement of the structure defined by the broken line of FIG. 2.

FIG. 2 shows the holster as it appears attached to a tactical vest with no firearm attached. Upper holster bracket (1) is secured to MOLLE web on a tactical vest. Lower holster bracket (9) is secured to MOLLE web that is located at a position below upper holster bracket (1). It can be seen that gravity assists in keeping the weapon in place when the user is in a standing, combat ready position, because of the orientation of the upper holster bracket (1) relative to the lower bracket (9) of the holster.

Figure 3:
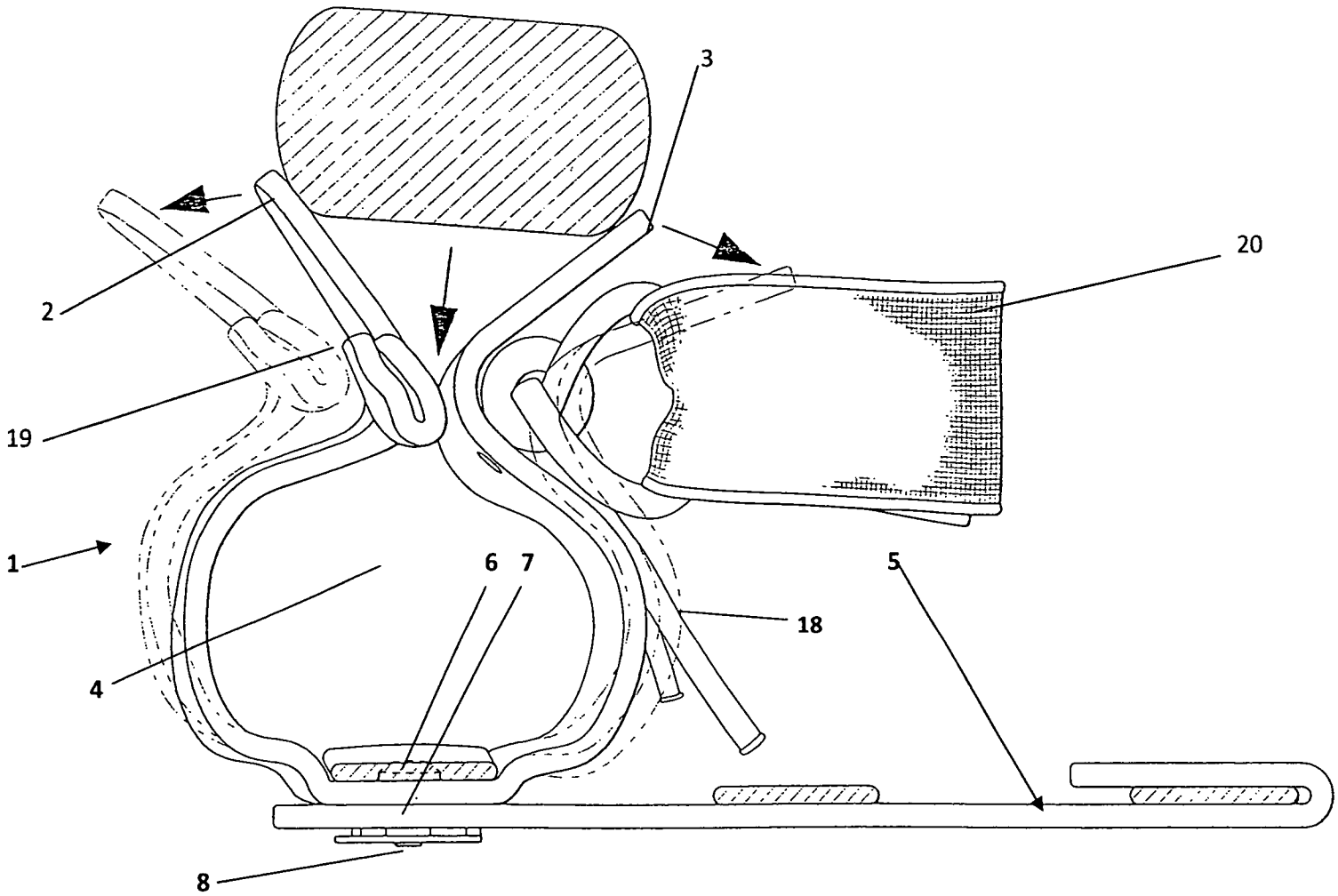
FIG. 3 shows the upper bracket of the holster with the pistol grip of an assault rifle aligned and ready to secure the assault rifle within the upper bracket.
Figure 4:
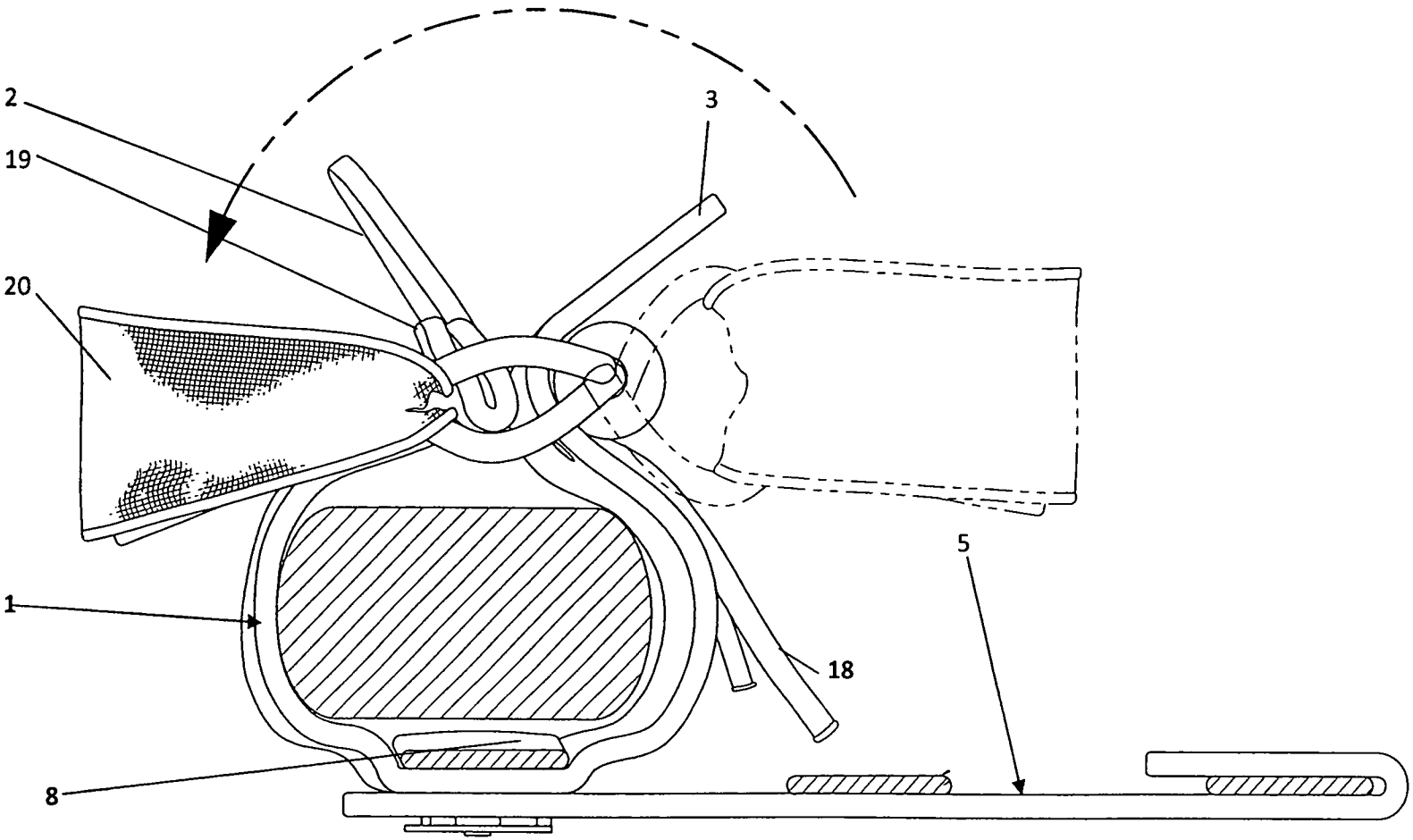
FIG. 4 shows the upper bracket of the holster of FIG. 3 with the pistol grip of an assault rifle secured by the upper bracket.

Referring to FIGS. 3 and 4, a single blank piece of thermoplastic with two terminal ends is used to form the upper bracket (1) of the holster. Wings (2) and (3) are thermoformed from the two terminal ends in a partial retrograde fashion to fold away from and oppose each other in the manner shown. Upper holster bracket (1) is formed from a somewhat flexible, but resilient thermoplastic. Wings (2) and (3) are manually spread apart in order to accept and surround the pistol grip of an assault weapon. Kydex® an acrylic-polyvinyl chloride is a preferred material. By spreading wings (2) and (3) apart, upper holster bracket (1) opens up wide enough to receive the pistol grip of the assault weapon inside of the somewhat elliptical space (4) defined by the upper bracket (1) of the holster. FIG. 4 shows upper holster bracket (1) with the pistol grip of an assault weapon in place. After receiving the pistol grip of the assault weapon in space (4), wings (2) and (3) rebound to their initial shape providing a secure sufficient compressive force on the weapon's pistol grip to securely affix the weapon to the torso of the user. An upper rigid MOLLE web fastener (5) is connected to upper holster bracket (1) with a screw, rivet, or other suitable fastener (8). The fastener extends through hole (6) located through the upper holster bracket (1) and through hole (7) located on MOLLE web fastener (5). Holes (6) and (7) register to enable attachment with the fastener (8). Any fastener that allows rotation of upper holster bracket (1) about upper MOLLE web fastener (5) while securely affixing upper holster bracket (1) to upper MOLLE web fastener (5) is suitable to the practice of the invention.

The rigid MOLLE web fastener (5) is formed from a one-piece thermoplastic blank with two terminal ends, distal and proximal. The distal end thermoformed to attach to a MOLLE web on the tactical vest, preferably an upper MOLLE web. Rigid upper MOLLE web fastener (5) is folded at the distal end 180 degrees in retrograde forming a slot adapted to slide over the top of a MOLLE web located on the tactical vest. It is important that the distal end of attachment member (5) be folded enough to provide a tight interference fit with the MOLLE web on the tactical vest to securely affix upper bracket (1) of the holster to the MOLLE web. Upper holster bracket (1) is rotatably attached to the proximal end of rigid MOLLE web fastener (5) with fastener (8) enabling upper holster bracket (1) to rotate freely about rigid MOLLE web fastener (5). The rotatable feature of the upper bracket (1) about the MOLLE web fastener (5) aids in keeping the assault weapon in place. When the user is in motion, gravity assists in keeping the assault weapon properly orientated.

FIGS. 3 and 4 show as elastic cord used to additionally secure an assault weapon to upper holster bracket (1). FIG. 3 shows elastic cord (18) before an assault weapon is holstered. Elastic cord (18) forms a closed loop and is affixed to one wing of upper holster bracket (1). A detent (19) is located on the opposite wing of upper holster bracket (1). Elastic cord (18) is secured to the wing facing detent (19) such that elastic cord (18) can be stretched and hooked to detent (19), securely affixing the assault weapon into the holster, as shown in FIG. 4. Elastic cord (18) secures the assault weapon until the user releases elastic cord (18). Tab (20) comprises a ribbon or equivalent woven or nonwoven sheet to facilitate finger contact with the elastic cord even when the user is wearing gloves. It is understood that detent (19) could be provided on either side or both sides of upper holster bracket (1) thereby enabling easy ambidextrous operation.

Figure 5:
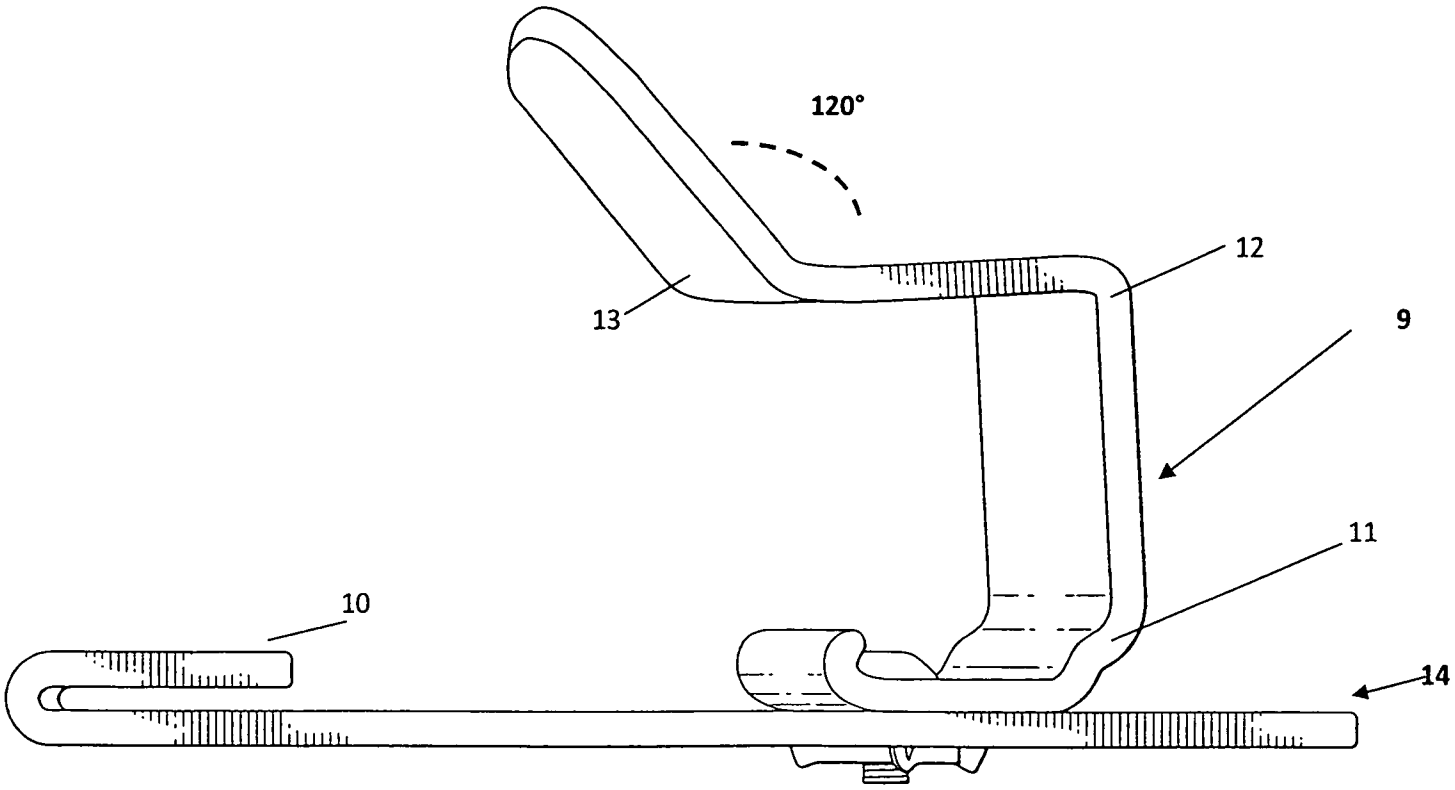
FIG. 5 shows the side view of the lower bracket of the instant holster separate from the tactical vest.

FIG. 5 shows the lower holster bracket (9) that is adapted to engage the magwell of an assault weapon. Similar to upper holster bracket (1) lower holster bracket (9) is adapted to slide over MOLLE web located on a tactical vest. Lower holster bracket (9) is located below upper holster bracket (1) to maintain the muzzle of the assault weapon pointing downwards toward the ground when a user is in a standing position. This ensures that an accidental discharge of the assault weapon is more likely to harmlessly strike the ground. Lower holster bracket (9) includes a lower MOLLE web fastener (14) rotatably screwed to the lower holster bracket (9). Lower holster attachment member (14) is preferably made from a suitable thermoplastic blank. The thermoplastic blank is folded 180 degrees in complete retrograde at the distal end as seen at (10) to form an open loop that slides over the top of the MOLLE web of a tactical vest. It is important that fold (10) be dimensioned such that fold (10) provides an adequate interference fit with the tactical vest MOLLE web to maintain the assault weapon securely against the user's torso. At the proximal end of lower MOLLE web fastener (14) another 180 degree fold in complete retrograde may optionally be included to provide a secure attachment to the lower portion of the tactical vest MOLLE web. Lower holster bracket (9) is roughly "U" shaped to accept the magwell of an assault rifle. Lower holster bracket (9) is formed preferably from a one-piece thermoplastic blank, having a distal end that attaches to the MOLLE web fastener (14) and a proximal end facing outward from the tactical vest. The blank is sequentially folded to form a bend (11) at the distal end of blank (9). Bend (11) is approximately 90 degrees relative to the unfolded portion of the blank where holster bracket (9) is adapted to attach to MOLLE webbing fastener (14), thereby abutting MOLLE web fastener (14) at approximately a perpendicular. The blank is then folded again approximately 90 degrees relative to the bend at (11) to form bend (12), thereby forming a length of lower holster bracket (9) that is approximately parallel to upper MOLLE web fastener (14). Bends (11) and (12) together form a somewhat "U" shaped slot adapted to receive the mag well of an assault rifle. Lower holster bracket (9) is finally folded approximately 120 degrees relative to bend (12) to form bend (13). Bend (13) widens the slot within which the magwell of the assault weapon rests.

In use the magwell of an assault weapon rests within and is supported by the "U" shaped channel of lower holster bracket (9) while upper holster bracket (1) securely attaches to the pistol grip of the assault weapon thereby providing two points of contact between the assault weapon and the tactical vest.

Figure 6:
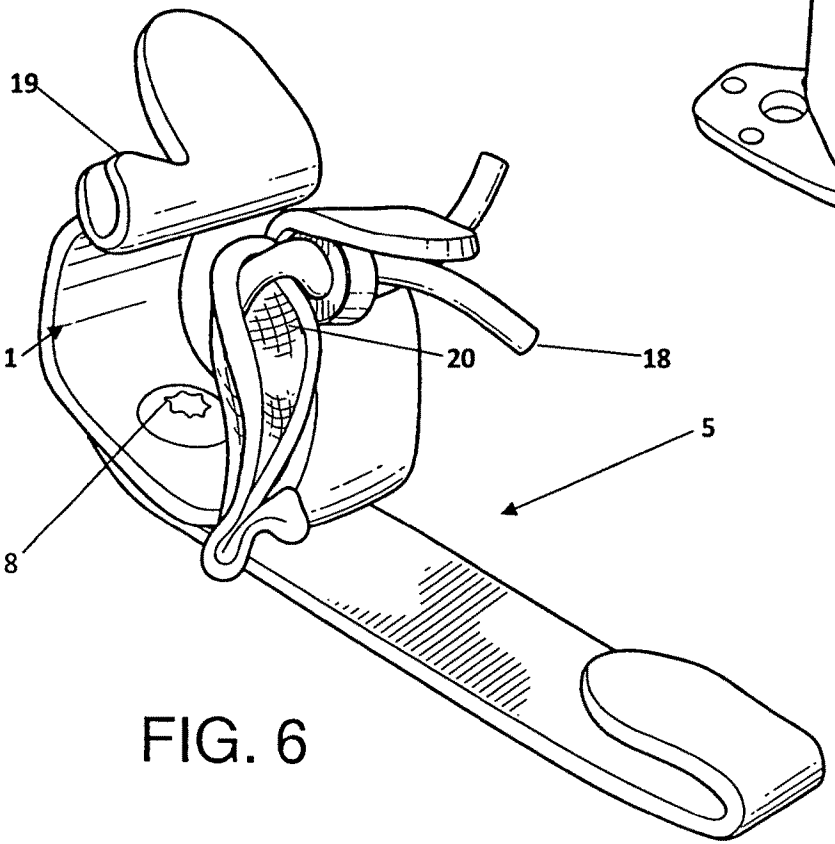
FIG. 6 shows the upper bracket of the instant holster in perspective and separate from the tactical vest.

FIG. 6 shows the structure of FIG. 3 in perspective. Screw (8) can be seen rotatably affixing upper holster bracket (1) to upper MOLLE webbing fastener (5). Because of the rotatable attachment of upper holster bracket (1) to upper MOLLE web fastener (5), the assault weapon has somewhat more freedom to adapt to the different orientations of a user when engaged in combat or unexpected conditions.

Figure 7:
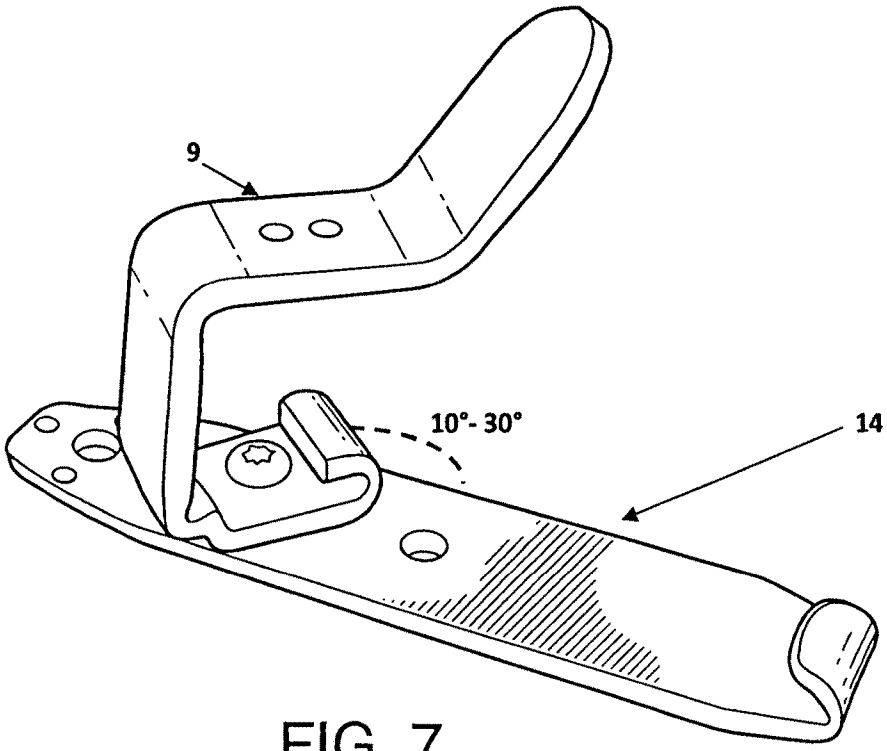
FIG. 7 shows the lower bracket of the instant holster in perspective and separate from the tactical vest.

Referring to FIG. 7 the lower holster bracket (9) is canted relative to lower MOLLE web fastener (14). Canting lower holster bracket (9) assists in maintaining the magwell of the assault weapon securely pointing towards the ground within lower holster bracket (9) when the weapon is stored in the holster. Canting also provides a more secure grip on the magwell of the assault weapon. A canting angle of 10 to 30 degrees is adequate. Canting can be accomplished by securing the lower holster bracket (9) to the lower MOLLE web fastener (14) such that the lower holster bracket (9) can rotate about lower MOLLE web fastener (14), in a manner similar to the attachment of upper holster bracket (1) to upper MOLLE web fastener (5). Alternatively, lower holster bracket (9) and lower MOLLE web fastener (14) can be made from one-piece of thermoplastic and the lower holster bracket (9) permanently canted.

What is claimed is:

1. A holster for mounting on the torso of a user wearing a MOLLE webbing having webs and used to carry an assault weapon having a pistol grip and a magwell, the holster comprising the combination of two separate brackets, an upper holster bracket having an open faced holder formed by two oppositely opposed flexible upper and lower wings adapted to directly engage and support the pistol grip of the assault weapon, and a lower holster bracket having an open faced holder formed by two upper facing flexible wings adapted to directly engage and support the magwell of the assault weapon.

2. The holster of claim 1 wherein the two flexible wings of the upper holster bracket are forwardly facing and can be manually spread apart in order to accept and surround by a secure interference fit the pistol grip of the assault weapon.

3. The holster of claim 1 wherein the two upper facing flexible wings form an approximate "U" shaped channel adapted to directly engage and receive the magwell of the assault weapon.

4. The holster of claim 3 wherein the "U" shaped channel of the lower holster bracket is connected by a pivot to a MOLLE web fastener to cant the "U" shaped channel to a downward facing position to maintain a muzzle of the assault weapon pointing downward when holding the magwell of the assault weapon.

5. The holster of claim 1 wherein the upper and lower holster brackets each are connected to MOLLE web fasteners having at least one slot adapted for securing by an interference fit the MOLLE webbing while sliding there over.

6. The holster of claim 5 wherein the at least one slot has an inner curved surface adapted to directly contact by the interference fit the MOLLE webbing.

7. The holster of claim 1 wherein the holster brackets are thermoplastic brackets.

8. The holster of claim 1 wherein the open faced holder of the upper holster bracket faces approximately horizontally outward and away relative to the user thereby permitting rapid outward removal by the user of the pistol hand grip from the holster.

9. The holster of claim 1 wherein the upper flexible wing of the upper holster bracket has a detent arm extending to one side of the open faced holder which detent arm has an elastic cord wrapped there around by a loop with the elastic cord also attached to the lower flexible wing of the upper holster bracket.

10. The holster of claim 1 wherein an opening of the open faced holder of the lower holster bracket faces approximately upwardly relative to the user thereby permitting rapid upward removal by the user from the open faced holder of the magwell of the assault weapon.

11. The holster of claim 10 wherein the two upper facing flexible wings of the lower holster bracket each have different lengths with one wing having a terminal end bent outwardly away from the shorter length wing to thereby widen the opening of the open faced holder.

12. A holster for mounting on the torso of a user wearing a tactical vest supporting at least one MOLLE webbing belt and used to carry an assault weapon having a pistol grip and a magwell, the improvement to the holster comprising:

(a) the combination of an upper holster bracket formed by two substantially similar flexible upper and lower wings, the two wings formed in a partially retrograde fashion to fold away from and oppose each to create a front facing opening which wings can be manually spread apart to partially surround and directly engage the pistol grip of the assault weapon; and (b) a lower holster bracket formed by first and second wings having opposed first and second terminal ends forming an approximate 'U" shaped channel having an upwardly facing opening adapted to engage and receive the magwell of the assault weapon, at least the first wing of the lower holster bracket being flexible and having the first terminal end extending above and outwardly from the approximate 'U' shaped channel to widen the upwardly facing opening to permit entry and removal of the magwell.

13. The holster of claim 12 wherein the upper holster bracket is attached to a fastener, the fastener having at least one terminal end with an open hooked surface, the open hooked surface positioned below the upper holster bracket, the open hooked surface facing upwardly and adapted for an interference fit permitting sliding engagement with a bottom of the at least one MOLLE webbing belt.

14. The holster of claim 13 wherein the upper wing of the first upper bracket has a curved hooked surface above the front facing opening and adapted for direct sliding engagement with a top of the at least one MOLLE webbing belt.

15. An improved holster for mounting on the torso of a user wearing a MOLLE webbing having at least one MOLLE webbing belt and used to carry an assault weapon having a pistol grip and a magwell, the holster comprising the an upper holster bracket having a first open faced holder formed by two flexible upper and lower wings which are biased to snap towards each other and adapted to directly engage and support the pistol grip of the assault weapon, and a lower holster bracket having a second open faced holder formed by two generally upwardly facing flexible wings which are biased to snap towards each other and adapted to directly engage and support the magwell of the assault weapon.

16. The holster of claim 15 wherein both the upper and lower holster brackets are attached by pivots to fasteners adapted to engage the at least one MOLLE webbing belt.

17. The holster of claim 16 wherein the fasteners each have at least one slot enabling an interference fit for sliding over the at least one MOLLE webbing belt.

18. The holster of claim 15 wherein the generally upwardly facing flexible wings are formed in an approximately "U" shaped channel secured by a pivot to a fastener adapted to engage the at least one MOLLE webbing belt.

19. The holster of claim 15 wherein the upper holster bracket is attached to a fastener having at least one terminal end with a hooked surface, the hooked surface adapted for sliding engagement with a bottom of the at least one MOLLE webbing belt.

20. The holster of claim 15 wherein the upper wing of the first upper holster bracket has a hooked surface located upwardly and facing downward of the lower wing of the first open faced holder with the hooked surface adapted for sliding engagement with the at least one MOLLE webbing belt.

* * * * *